US010014092B2

(12) United States Patent
Koeppendoerfer et al.

(10) Patent No.: US 10,014,092 B2
(45) Date of Patent: Jul. 3, 2018

(54) ELECTRICAL LINE AND METHOD FOR MANUFACTURING AN ELECTRICAL LINE

(71) Applicant: LEONI KABEL HOLDING GMBH, Nuremberg (DE)

(72) Inventors: Erwin Koeppendoerfer, Schwabach (DE); Markus Schill, Munich (DE)

(73) Assignee: LEONI Kabel Holding GmbH, Nuremberg (DE)

( * ) Notice: Subject to any disclaimer, the term of this patent is extended or adjusted under 35 U.S.C. 154(b) by 0 days.

(21) Appl. No.: 15/180,282

(22) Filed: Jun. 13, 2016

(65) Prior Publication Data

US 2016/0365167 A1 Dec. 15, 2016

(30) Foreign Application Priority Data

Jun. 12, 2015 (DE) ..... 10 2015 210 867

(51) Int. Cl.

| | |
|---|---|
| ***H01B 3/00*** | (2006.01) |
| ***H01B 7/02*** | (2006.01) |
| ***H01B 7/18*** | (2006.01) |
| ***H01B 3/30*** | (2006.01) |
| ***H01B 13/14*** | (2006.01) |

(52) U.S. Cl.

CPC ..... *H01B 7/0275* (2013.01); *H01B 3/30* (2013.01); *H01B 7/1845* (2013.01); *H01B 13/14* (2013.01)

(58) Field of Classification Search

CPC ..... H01B 3/00
USPC ..... 174/110 R, 120 R
See application file for complete search history.

(56) References Cited

U.S. PATENT DOCUMENTS

| | | | | |
|---|---|---|---|---|
| 3,333,037 | A | 7/1967 | Humphrey et al. | |
| 3,580,988 | A * | 5/1971 | Orlowski | H02G 3/0616 16/2.2 |
| 4,979,794 | A * | 12/1990 | Evans | G02B 6/4463 385/109 |
| 5,430,255 | A * | 7/1995 | Downie | B29C 47/0016 156/50 |
| 2010/0276178 | A1* | 11/2010 | Keller | H01B 7/0275 174/113 C |
| 2013/0126209 | A1 | 5/2013 | Heffner | |
| 2014/0367140 | A1* | 12/2014 | Abe | H01B 11/1834 174/102 R |

FOREIGN PATENT DOCUMENTS

| | | | |
|---|---|---|---|
| AT | 511018 | A1 | 8/2012 |
| DE | 10102256 | A1 | 8/2002 |
| EP | 2410535 | A1 | 1/2012 |
| EP | 2477195 | A2 | 7/2012 |
| GB | 2262647 | A | 6/1993 |

* cited by examiner

*Primary Examiner* — Chau N Nguyen
(74) *Attorney, Agent, or Firm* — Laurence A. Greenberg; Werner H. Stemer; Ralph E. Locher

(57) ABSTRACT

An electrical line has a core and an insulating sheath that is extruded onto the core. A structured surface having a plurality of structural elements stamped into it is formed over the entire surface of the insulating sheath. The stamped structure is a microstructure, wherein the individual structural elements have a stamping depth of at most 0.15 mm.

15 Claims, 2 Drawing Sheets

ELECTRICAL LINE AND METHOD FOR MANUFACTURING AN ELECTRICAL LINE

BACKGROUND OF THE INVENTION

Field of the Invention

The invention relates to an electrical line that extends in a longitudinal direction and has a core and an insulating sheath that is extruded onto the core. The invention further relates to a method for manufacturing an electrical line of this kind.

The term "electrical line" is understood in the present document to mean on the one hand (single) wires that are formed by a central electrical conductor core and an insulating sheath that surrounds the latter and is called a wire insulation. On the other hand, the term "electrical line" is also understood in the present document to mean so-called sheathed lines, in which a plurality of elements, for example a plurality of single wires, are grouped into a common core and are then surrounded by a cable sheath that forms the insulating sheath. In the case of a single wire, the electrical conductor forms the core.

The insulating sheath of electrical lines of this kind is applied by an extrusion method. Here, the core is pulled through an extrusion head to which a plastic synthetic melt is fed uninterruptedly, as the sheath material, in a continuous process for forming the sheath. Conventionally, downstream of the extrusion head the electrical line is pulled through a cooling bath, in particular a water bath, in order to achieve as rapid as possible a solidification of the initially viscous sheath material of the insulating sheath.

As a result of the conditions of the extrusion process, in lines of this kind the insulating sheath typically has a very smooth surface. In particular when polyurethane (PU) is used as the material for the insulating sheath, this results in the insulating sheath adhering to surfaces. Since, after manufacture, lines of this kind are conventionally rolled onto storage and transport drums and are later unrolled therefrom again, this results in certain problems during unrolling. As a result of the pronounced adhesion, the so-called "stick slip effect" is also inter alia encountered, which occurs in particular if the static friction is significantly greater than the sliding friction.

BRIEF SUMMARY OF THE INVENTION

Taking this as a starting point, the object of the invention is to provide an electrical line and a method for its manufacture wherein these undesirable friction effects are at least reduced.

The object is achieved according to the invention by an electrical line having the features of the main apparatus claim. The line extends in a longitudinal direction and has a core and an insulating sheath that is extruded onto the core. A structure that extends in the longitudinal direction and has a plurality of structural elements, which are in particular repeated periodically, is stamped into the surface of the insulating sheath.

It is of essential significance here that the surface is not a smooth surface, as is the case with conventional extruded insulating sheaths. Rather, the surface is characterized by a stamped structure such that depressions and elevations are formed in the surface. These are defined by the individual structural elements that are in particular repeated periodically. The formation of this structured surface takes as its starting point here the realization that with structured surfaces a reduction in the friction or the flow resistance can frequently be achieved. Thus, for example, in the case of golf balls having the dimple- or crater-like surface structure that is typical thereof, it is known that this specific structure improves the aerodynamics in comparison with a smooth surface.

Tests have now shown that this insulating sheath that is provided with a corresponding (micro)structuring also displays significantly better properties in comparison with the problems mentioned at the outset in respect of adhesion.

In general, in the present document the term "stamped structure" is understood to mean that depressions are made in the surface in order to form the individual structural elements. This is done during manufacture by a stamping element, in particular a stamping wheel, which thus stamps the structures into the still plastic insulating sheath downstream of the extrusion head.

As a result of the specifically formed surface structure, adhesion and friction are thus initially reduced in a particularly advantageous manner, such that in particular better unrolling from a drum is achieved. Moreover, however, the reduction in the flow resistance is also of interest in that during the manufacturing method the line that is produced is pulled through a cooling bath that is filled with a cooling liquid. Because of the high speeds during cable manufacture, the liquid in the cooling bath exerts a flow resistance on the electrical line that is not negligible and results at least in an increased energy requirement. In the case of thin lines, in some circumstances this may also result in tearing or in a restriction on the maximum take-off speed. The take-off speed of a single wire is typically in the region of 1000 to 4000 meters per minute, and for sheath extrusion of a cable sheath it is around 100 to approximately 500 meters per minute.

Finally, a further crucial advantage can be seen overall in a saving on material. Because of the stamped structural elements, in fact—with the same nominal external diameter as a smooth surface of the insulating sheath—material is saved. At the same time, the mechanical and electrical properties that are demanded of a comparable line having a smooth surface and the same external diameter are retained.

Overall, the structure is preferably a stamped microstructure. This term is understood to mean that the individual structural elements have a stamping depth of <0.15 mm and in particular <0.07 mm. For example, the stamping depth is around 0.05 mm. The lower limit of the stamping depth is in this case typically around 0.02 mm. Typical wall thicknesses of the insulating sheath are conventionally approximately 0.2 mm in the case of thin lines, for example thin wires, and approximately 1.5 mm in the case of very thick wires or cable sheaths. The stamping depth is thus for example approximately 8 to 15% of the wall thickness of the insulating sheath. Too great a stamping depth may result in an effect on the electrical and/or mechanical properties. If the value falls below the minimum stamping depth of approximately 0.02 mm, there is a risk that during stamping no plastic deformation can be achieved.

Preferably, the structure extends over the entire surface. This means that the structure is formed continuously in both the peripheral direction and the longitudinal direction. Depending on the stamping method, if need be thin strip-shaped regions (in the longitudinal direction) may have a smooth surface. Advantageously, the individual structural elements are in this case formed such that they are repeated periodically in the longitudinal direction.

As a result of the stamping, each structural element has a respective hollow in which the surface is thus recessed in comparison with a nominal external diameter. In this case, the hollows cover at least 30% and preferably at least 50% or even 75% of the surface. The remaining spaces between the hollows are then preferably formed by surface regions having (at most) the nominal external diameter.

According to a preferred first variant embodiment, the structure is in this case formed in the manner of a crater landscape in which the individual structural elements take the form in particular of partially spherical hollows. As seen in the longitudinal direction, these hollows, also called indentations, are preferably arranged in a row with one another, in the manner of a string of pearls. Here, two adjacent strings are arranged offset from one another in the longitudinal direction, in particular by approximately half the diameter of a respective hollow.

In general, the structural elements, in particular in the case of the formation in the variant embodiment of a crater landscape, have an extent in the longitudinal direction and/or the peripheral direction of at most 0.5 mm and in particular at most 0.3 mm. Specifically, they have for example a diameter of 0.1 mm. The minimum diameter is preferably around 0.05 mm.

Additionally, it is furthermore provided for the structural elements to be spaced from one another in the longitudinal direction and/or the peripheral direction by at most 1 mm and preferably at most 0.5 mm. Advantageously, the spacing is less than the extent of the respective structural element, in particular the indentation.

According to a preferred alternative to the embodiment as a crater landscape, the surface takes the form of an imbricated surface, and the individual structural elements are each formed by obliquely positioned imbricated forms. Here, the term "obliquely positioned" is understood to mean that the individual imbricated forms have a surface that is oriented to be inclined in respect of the longitudinal direction.

The imbricated forms also have the shallow stamping depth that was already mentioned above, of 0.15 mm and in particular <0.07 mm. As seen in the longitudinal direction or the peripheral direction, the imbricated forms have a larger extent than the indentations of the crater landscape, for example being in the region of a few millimeters, specifically from 5 mm to 10 mm. In principle, it is also possible to make smaller imbricated forms.

In a preferred embodiment, it is provided in this context for a plurality of imbricated forms also to be formed distributed over the periphery such that, as seen in cross section, a surface having a varying radius is formed in the peripheral direction as well.

In a preferred embodiment, the material used for the insulating sheath is polyurethane (PU). The undesirable adhesion that was described at the outset is reduced by the microstructured surface that is presented here to a particularly significant extent in the case of PU insulating sheaths of this kind.

Furthermore, the insulating sheath is advantageously a wire sheath of a (single) wire. In principle, the micro structured surface may also form cable sheaths of a sheathed line.

According to the invention, the object is furthermore achieved by a method for manufacturing an electrical line of this kind, having the features of the main method claim. For manufacture, first the insulating sheath is extruded onto a core with the aid of an extruder. Downstream of the sheath extrusion, the stamping structure having a plurality of structural elements is stamped into the still plastically deformable material of the insulating sheath. For this purpose, a stamping device that ensures the desired plastic deformation of the sheath material by means of a mechanical contact pressure is used. Thus, during this the sheath material is displaced, out of regions that then form the hollows, to the side, and at that location forms the nominal external diameter of the line. Thus, as a result of the stamping, the line undergoes a thickening, as a result of which the diameter of the insulating sheath is higher downstream of the stamping device. For this reason, it is preferred for the diameter of the extrusion head to be dimensioned such that the diameter of the line downstream of the extrusion head is at least somewhat less than the target nominal diameter of the line. The nominal diameter is achieved only downstream of the stamping device.

In this context, the stamping device is in particular at least one and preferably a plurality of stamping elements, in particular stamping wheels, that are arranged offset from one another around the periphery. In this case, the stamping wheels are arranged such that they are rotatable about an axis. The stamping wheels and in general the stamping elements are pressed against the insulating sheath with a mechanical contact pressure. The stamping wheels are optionally driven actively. Preferably, however, they are mounted to run freely, such that they are driven in rotation automatically, that is to say they are driven solely by mechanical friction, by take-off of the electrical line downstream of the extrusion head.

In this context, the stamping device is conventionally arranged immediately downstream of the extrusion head, typically in the region from 5 cm to 50 cm downstream of the extrusion head. In this region, it is guaranteed that the sheath material is still soft enough to achieve the desired plastic deformation.

In an advantageous further development of the method, the stamping takes place within a cooling bath and hence within a cooling liquid. The stamping device is thus arranged in particular in the cooling liquid. This construction is based on a reflection that some sheath materials have a very tacky surface immediately downstream of the extrusion head, and in the case of such materials, such as PU, stamping without tearing away the sheath material is only possible to a limited extent. By arranging it within the cooling bath, stamping takes place in a region where a first thin outer skin of the insulating sheath, which has a significantly lower degree of tack, has already formed. At the same time, however, the insulating sheath as a whole continues to be plastically deformable. A cooling bath of this kind is typically a plurality of meters, in particular a plurality of tens of meters, in length, for example from 20 m to 30 m. In this case, the stamping device is arranged in the front region, for example in the first fifth and specifically immediately, for example 20 cm to 100 cm and preferably at most 50 cm, downstream of the entry of the line into the cooling bath.

BRIEF DESCRIPTION OF THE SEVERAL VIEWS OF THE DRAWING

An exemplary embodiment will be described in more detail below with reference to the figures. In the latter, in each case in simplified illustrations.

DESCRIPTION OF THE INVENTION

Figure 1:
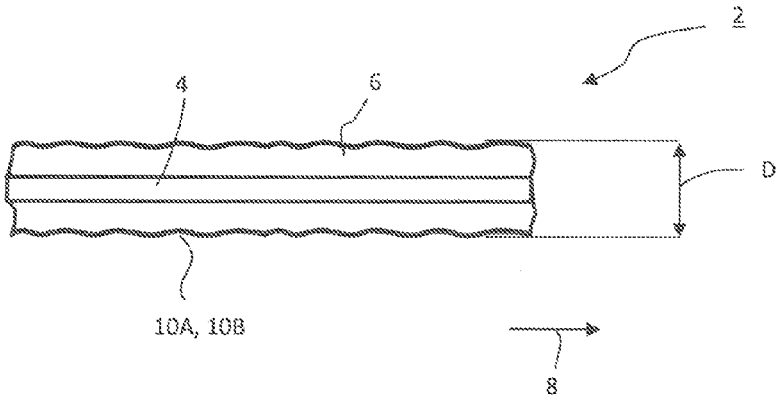
FIG. 1 shows part of a longitudinal sectional illustration of an electrical line in the form of a single wire.

In the figures, equivalent parts are provided with like reference numerals.

The electrical line 2 that is illustrated in FIG. 1 takes the form of an electrical wire that has an electrical conductor, as the core 4, and an insulating sheath 6 that surrounds the latter. The line 2 extends in a longitudinal direction 8. The line 2 is an "endless" product that is initially not premanufactured and is rolled onto a cable drum, typically with a length of a plurality of hundreds of meters or indeed a plurality of kilometers. It has a nominal external diameter D.

As already indicated in FIG. 1, the insulating sheath 6 generally has a structured surface 10A, 10B. This is a microstructure having a plurality of stamped structural elements 12A, 12B.

Two different preferred variant embodiments of possible structured surfaces 10A, 10B are illustrated in FIGS. 2, 3 and 4, 5 respectively.

Figure 2:
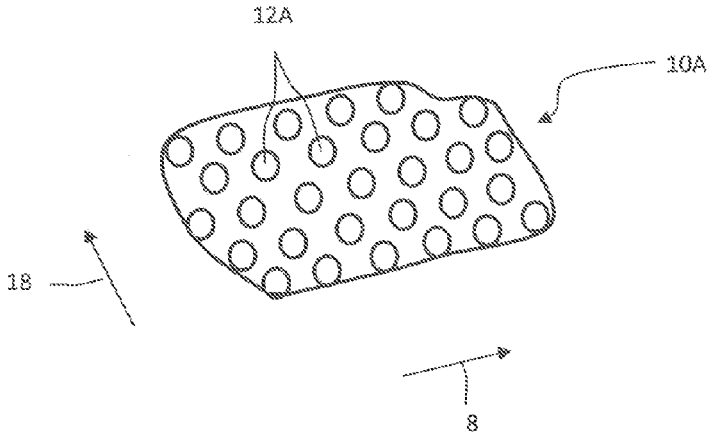
FIG. 2 shows part of a highly simplified plan view of the structured surface of the insulating sheath of the electrical line, according to a first variant, in which the surface takes a form in the manner of a crater landscape.
Figure 3:
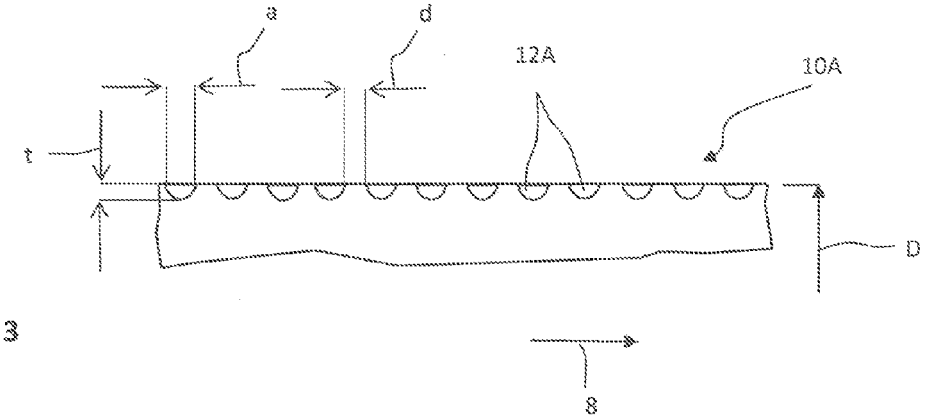
FIG. 3 shows part of a sectional illustration of the structured surface that is illustrated in FIG. 2.

The variant embodiment in FIG. 2 is the structured surface 10A in the manner of a crater landscape, wherein the individual structural elements here are formed by individual hollows 12A. These hollows 12A are stamped in the manner of indentations having an approximately hemispherical shape. The hollows 12A each have a stamping depth t that is typically only in the region of 0.05 mm. At the same time, the hollows 12A have an extent a that is preferably approximately 0.1 mm. In the region of the hemispherical hollows 12A, the latter thus have a circular peripheral contour, and the extent a corresponds to the diameter of this peripheral contour. Both in the longitudinal direction 8 and in a peripheral direction 18, mutually adjacent structural elements 12 Are at a spacing d that, in the variant embodiment of FIG. 2, is for example in the region of the extent a or indeed somewhat below this.

Figure 4:
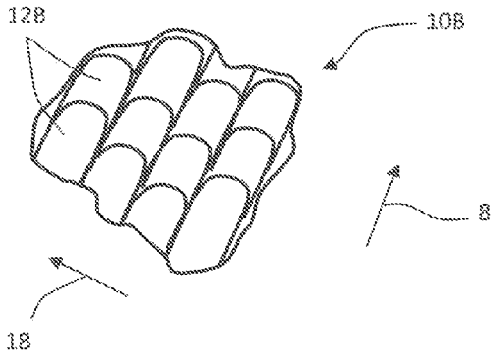
FIG. 4 shows a second variant embodiment of the structured surface, which takes the form of an imbricated surface.
Figure 5:
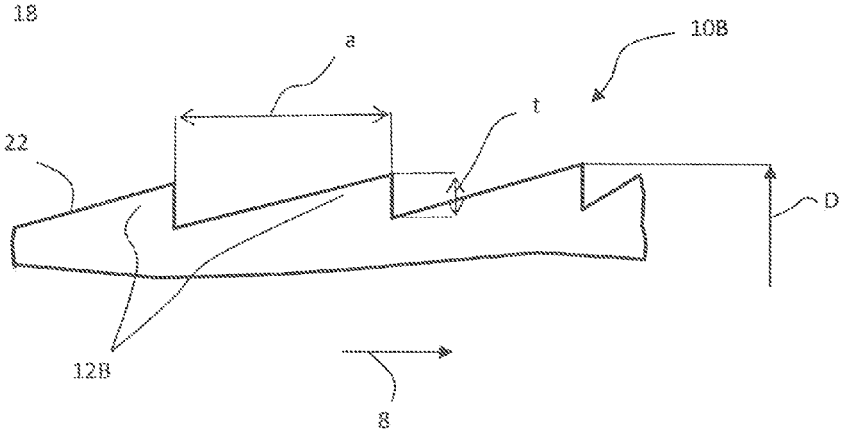
FIG. 5 shows part of a cross sectional illustration of the imbricated surface that is illustrated in FIG. 4.

In the alternative embodiment according to FIGS. 4 and 5, the surface is formed as an imbricated surface 10B, and the individual structural elements are formed by individual imbricated forms 12B. These too have a stamping depth t preferably in the region of 0.05 mm. The extent a of the individual imbricated forms 12B, in particular in the longitudinal direction 8, is preferably somewhat larger than those of the hollows 12A and is preferably in the region of just a few millimeters. A respective imbricated form 12B has a surface 22 similar to a fish scale that runs in an oblique orientation in respect of the longitudinal direction 8. The highest region of a respective imbricated form 12B, that is to say the segment having the largest diameter, at the same time defines the nominal external diameter D of the electrical line 2. In the longitudinal direction 8, the individual elements 22 similar to a fish scale are directly adjacent to one another, since they themselves, in each case in part-segments, so to speak, create the surface having the nominal external diameter D.

Figure 6:
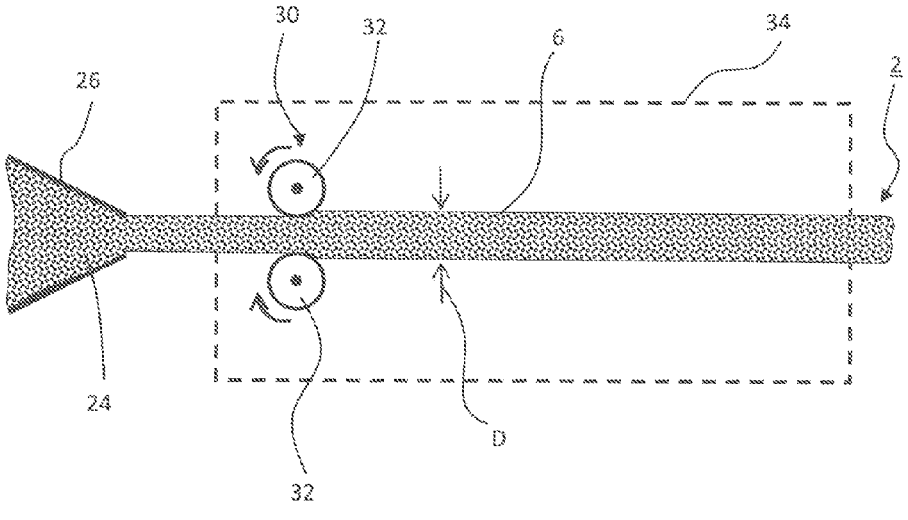
FIG. 6 shows a highly simplified schematic illustration of an extrusion plant for manufacturing the electrical line.

For manufacturing a line 2 of this kind, first a conventional extrusion method is used, as explained in relation to FIG. 6: the core 4 is fed, together with sheath material 24, to an extrusion head 26 such that the insulating sheath 6 is formed downstream of the extrusion head 26. Directly adjacent to the extrusion head 26, typically at a spacing of a few tens of centimeters, for example at a spacing of from 20 cm to 50 cm, a stamping device 30 is arranged for forming the structured surface 10, and this stamping device 30 has in the present case a plurality of stamping wheels 32, in particular two. These are mounted such that they are rotatable about an axis of rotation in the manner of free-running deflection rollers. On their peripheral edge, they conventionally have a convexly curved casing surface having a radius that corresponds to the radius of the insulating sheath 6. Formed on this casing surface are suitable stamping elements, for example in the form of bumps, for forming the hollows 12A.

In the exemplary embodiment that is illustrated in FIG. 6, the stamping device 30 is furthermore arranged in a water or cooling bath 34, which is illustrated by a dashed line. In particular, the stamping wheels 32 are here arranged under water.

For manufacture, the line 2 is pulled through the cooling bath 34 at high take-off speed. During this, the structured surface 10A, 10B that extends over the entire length of the line 2 is continuously formed by the stamping wheels 32. In this case, the structural elements 12A, 12B cover the insulating sheath 6 over its entire surface, preferably also in the peripheral direction 18.

In the variant embodiment of FIG. 6, the two stamping wheels 32 are arranged at the same longitudinal position. As an alternative to this, they may also be arranged at different longitudinal positions, that is to say offset from one another in the longitudinal direction 8. Specifically, it is also possible for more than two stamping wheels 32 to be formed, for example two, three or four stamping wheels, such that the surface is provided with the structural elements 12 As uniformly as possible. The individual stamping wheels 32 are in this case arranged offset from one another in the peripheral direction 18.

LIST OF REFERENCE NUMERALS

2 Line
4 Core
6 Insulating sheath
8 Longitudinal direction
10A, B Surface
12A Hollow
12B Imbricated form
18 Peripheral direction
22 Surface similar to a fish scale
24 Sheath material
26 Extrusion head
30 Stamping device
32 Stamping wheel
34 Cooling bath
a Extent
d Spacing
D Nominal diameter
t Stamping depth

The invention claimed is:

1. An electrical line extending in a longitudinal direction, the electrical line comprising:

a core; and an insulating sheath extruded onto said core, said insulating sheath having a structure extending in the longitudinal direction and said structure having plurality of structural elements being stamped into said insulating sheath to form a structured surface, said structured surface having a form of an imbricated surface and said structural elements each taking a form of an obliquely positioned imbricated form, wherein a plurality of obliquely positioned imbricated forms taking a form distributed in a peripheral direction.

2. The line according to claim 1, wherein said structure is a microstructure in which individual ones of said structural elements have a stamping depth of less than 0.15 mm.

3. The line according to claim 1, wherein:

said structure extends over an entire surface of said insulating sheath; and said structural elements are formed such that they are repeated periodically in the longitudinal direction.

4. The line according to claim 1, wherein said structural elements have hollows, and said hollows cover at least 30% of said structured surface.

5. The line according to claim 1, wherein said structural elements have an extent in at least one of the longitudinal direction or a peripheral direction of at most 0.5 mm.

6. The line according to claim 1, wherein said insulating sheath is made of an insulating material being polyurethane.

7. The line according to claim 1, wherein said insulating sheath is a wire sheath of a wire.

8. The line according to claim 1, wherein said structure is a microstructure in which individual ones of said structural elements have a stamping depth of less than 0.07 mm.

9. The line according to claim 1, wherein said structural elements have hollows, and said hollows cover at least 50% of a surface of said structured surface.

10. The line according to claim 1, wherein said structural elements have an extent in at least one of the longitudinal direction or a peripheral direction of at most 0.3 mm.

11. The line according to claim 1, wherein said structural elements are spaced from one another in at least one of the longitudinal direction or a peripheral direction by at most 0.5 mm.

12. A method for manufacturing an electrical line extending in a longitudinal direction, which comprises the steps of:

providing a core;

extruding an insulating sheath onto said core; and stamping a structured surface having a plurality of structural elements into the insulating sheath still being soft downstream of an extrusion of the insulating sheath, the structured surface having a form of an imbricated surface and the structural elements each taking a form of an obliquely positioned imbricated form, wherein a plurality of obliquely positioned imbricated forms taking a form distributed in a peripheral direction.

13. The method according to claim 12, which further comprises forming the structured surface by at least one stamping wheel.

14. The method according to claim 12, which further comprises disposing, downstream of an extrusion head, a cooling bath through which the core is guided, and the stamping of the structural elements takes place in the cooling bath.

15. The method according to claim 12, which further comprises forming the structured surface by a plurality of stamping wheels that are disposed offset from one another around a periphery of the insulating sheath.

* * * * *